US009816041B2

(12) United States Patent
D'Acosta

(10) Patent No.: US 9,816,041 B2
(45) Date of Patent: Nov. 14, 2017

(54) AVIATION GASOLINES CONTAINING MESITYLENE AND ISOPENTANE

(71) Applicant: Swift Fuels, LLC, West Lafayette, IN (US)

(72) Inventor: Chris D'Acosta, West Lafayette, IN (US)

(73) Assignee: Swift Fuels, LLC, West Lafayette, IN (US)

( * ) Notice: Subject to any disclaimer, the term of this patent is extended or adjusted under 35 U.S.C. 154(b) by 0 days.

(21) Appl. No.: 14/564,281

(22) Filed: Dec. 9, 2014

(65) Prior Publication Data

US 2015/0175918 A1 Jun. 25, 2015

Related U.S. Application Data

(60) Provisional application No. 61/913,658, filed on Dec. 9, 2013.

(51) Int. Cl.
*C10L 1/00* (2006.01)
*C10L 1/06* (2006.01)

(52) U.S. Cl.
CPC ..... *C10L 1/06* (2013.01); *C10G 2300/305* (2013.01)

(58) Field of Classification Search
CPC .... C10L 1/04; C10L 10/10; C10L 1/06; C10L 1/1608; C10L 2270/023; C10L 1/10; C10G 2300/305
USPC ..... 585/1, 14
See application file for complete search history.

(56) References Cited

U.S. PATENT DOCUMENTS 1,315,585 A 9/1919 Weizmann
1,713,589 A 5/1929 Bereslavsky
2,401,983 A 6/1946 Stanly et al.
2,413,262 A * 12/1946 Stirton ..... C10L 1/00 44/426
2,422,674 A 6/1947 Haensel et al.
2,425,096 A 8/1947 Ipatieff et al.
2,425,559 A 8/1947 Passino et al.
(Continued)

FOREIGN PATENT DOCUMENTS

EP 0 460957 A2 12/1991
EP 0 526129 A1 2/1993
(Continued)

OTHER PUBLICATIONS

Bird, C.W., Transition Metal Intermediates in Organic Syntehsis, New York, Lond: Academic Press, 1967, pp. 1-29.
(Continued)

*Primary Examiner* — Pamela H Weiss
(74) *Attorney, Agent, or Firm* — Woodard, Emhardt, Moriarty, McNett & Henry LLP

(57) ABSTRACT

Describe are preferred formulations for Avgas meeting the requirements for use in aircraft, including requirements established under ASTM standards and by the Federal Aviation Administration. In one embodiment, a binary mixture of 1,3,5-trimethyl benzene (mesitylene) and isopentane is used to provide a MON of at least 100, and more preferably at least 102. In other embodiments, the amounts of mesitylene and/or isopentane may be changed, and other fuel components are included. These various Avgas formulations are thereby adjusted to meet a variety of requirements as to octane rating, RVP, cold start, and other fuel characteristics.

12 Claims, 2 Drawing Sheets

MON versus percentage mesitylene

(56) References Cited

U.S. PATENT DOCUMENTS

| | | | | |
|---|---|---|---|---|
| 2,506,539 | A | 5/1950 | Boardman | |
| 2,589,621 | A | 3/1952 | McCaulay et al. | |
| 2,593,561 | A | 4/1952 | Herbst et al. | |
| 2,917,561 | A | 12/1959 | Eby | |
| 3,201,485 | A | 8/1965 | Kovach | |
| 3,267,165 | A | 8/1966 | Kimble et al. | |
| 3,301,912 | A | 1/1967 | Hwang et al. | |
| 3,946,079 | A | 3/1976 | Mizutani et al. | |
| 4,006,149 | A | 2/1977 | Bonnemann et al. | |
| 4,300,009 | A | 11/1981 | Haag et al. | |
| 4,368,056 | A | 1/1983 | Pierce et al. | |
| 4,398,920 | A | 8/1983 | Guibet et al. | |
| 4,398,921 | A | 8/1983 | Rifkin et al. | |
| 5,063,156 | A | 11/1991 | Glassner et al. | |
| 5,087,781 | A | 2/1992 | Schutz et al. | |
| 5,470,358 | A | 11/1995 | Gaughan | |
| 6,271,433 | B1 | 8/2001 | Keady et al. | |
| 6,353,143 | B1 | 3/2002 | Fang et al. | |
| 6,555,350 | B2 | 4/2003 | Ahring et al. | |
| 6,648,931 | B1 | 11/2003 | Rao | |
| 6,908,591 | B2 | 6/2005 | MacPhee et al. | |
| 6,982,155 | B1 | 1/2006 | Fukuda et al. | |
| 6,991,810 | B1 | 1/2006 | Grundy et al. | |
| 6,998,050 | B2 | 2/2006 | Nakajoh et al. | |
| 7,141,083 | B2 | 11/2006 | Jordan | |
| 7,462,207 | B2 | 12/2008 | Clark | |
| 7,834,230 | B2 | 11/2010 | Fujimoto et al. | |
| 8,049,048 | B2 * | 11/2011 | Rusek | C07C 1/2074 585/1 |
| 8,628,594 | B1 * | 1/2014 | Braly | C10L 1/06 44/426 |
| 8,686,202 | B2 * | 4/2014 | Rusek | C07C 1/2074 585/14 |
| 8,840,689 | B2 * | 9/2014 | Mathur | C10L 1/224 44/361 |
| 9,074,153 | B2 * | 7/2015 | Landschof | C10L 1/023 |
| 2002/0045785 | A1 * | 4/2002 | Bazzani | C10L 1/023 585/14 |
| 2002/0055663 | A1 | 5/2002 | Barnes et al. | |
| 2003/0040650 | A1 * | 2/2003 | Butler | C10L 1/06 585/14 |
| 2003/0183554 | A1 * | 10/2003 | Bazzani | C10L 1/02 208/16 |
| 2004/0020106 | A1 | 2/2004 | Tack et al. | |
| 2006/0051848 | A1 | 3/2006 | Nishio et al. | |
| 2006/0052650 | A1 * | 3/2006 | Thebault | C10L 1/06 585/14 |
| 2007/0135318 | A1 | 6/2007 | Singh et al. | |
| 2007/0175088 | A1 | 8/2007 | Selkirk | |
| 2008/0134571 | A1 * | 6/2008 | Landschof | C10L 1/023 44/424 |
| 2008/0168706 | A1 | 7/2008 | Rusek et al. | |
| 2008/0244961 | A1 * | 10/2008 | Rusek | C07C 1/2074 44/307 |
| 2008/0244962 | A1 | 10/2008 | Abhari et al. | |
| 2008/0244963 | A1 * | 10/2008 | Demoment | C10L 1/023 44/322 |
| 2009/0000185 | A1 | 1/2009 | Aulich et al. | |
| 2009/0013591 | A1 | 1/2009 | Bradin et al. | |
| 2009/0117619 | A1 | 5/2009 | Hutcheson et al. | |
| 2009/0203098 | A1 | 8/2009 | Verser | |
| 2010/0268005 | A1 * | 10/2010 | Rusek | C07C 1/2074 585/302 |
| 2010/0293841 | A1 | 11/2010 | Zuckerman | |
| 2010/0298615 | A1 | 11/2010 | Rusek et al. | |
| 2011/0114536 | A1 * | 5/2011 | Demoment | C10L 1/06 208/16 |
| 2012/0029251 | A1 * | 2/2012 | Hemighaus | C10L 1/04 585/14 |
| 2013/0139431 | A1 * | 6/2013 | Russo | C10L 1/1824 44/451 |
| 2014/0116367 | A1 * | 5/2014 | Braly | C10L 1/14 123/1 A |

FOREIGN PATENT DOCUMENTS

| | | | |
|---|---|---|---|
| JP | 57145181 | 9/1982 | |
| JP | 62-278989 | 12/1987 | |
| WO | WO 98/51813 | 11/1998 | |
| WO | WO 2007/004789 A1 | 1/2007 | |
| WO | WO 2008/013922 A1 | 1/2008 | |
| WO | WO 2009/152495 A2 | 12/2009 | |
| WO | WO 2011109575 A2 * | 9/2011 | C07C 1/2074 |

OTHER PUBLICATIONS

Colket et al., Development of an Experimental Database and Kinetic Models for Surrogate Jet Fuels, Mar. 1, 2007, American Institute of Aeronautics, pp. 1-21.

English Abstract for JP 57145181.

Englsih Abstract for JP 62-278989.

International Search Report and Written Opinion issued in PCT/US2014/036646, dated Sep. 17, 201416 pgs.

International Search Report and Written Opinion dated Oct. 19, 2011, in corresponding International Application No. PCT/US2011/037505.

International Search Report dated Nov. 8, 2011 in corresponding International Application No. PCT/US2011/026948.

Roubaud et al, Oxidation and Combustion of Low Alkylbenzenes at High Pressure, 2000, Combustion and Flame 121:535-541.

Zaldivar et al. Abstract, Applied Microbiology Biotechnology (2001), pp. 17-34, vol. 56.

* cited by examiner

Distillation curve of TA-55

MON versus percentage mesitylene

AVIATION GASOLINES CONTAINING MESITYLENE AND ISOPENTANE

REFERENCE TO RELATED APPLICATIONS

The present application claims priority to U.S. Provisional Patent Application Ser. No. 61/913,658, filed Dec. 9, 2013, the contents of which are hereby incorporated by reference.

FIELD OF THE INVENTION

The present invention relates to aviation fuels comprising mesitylene and isopentane. These fuels may optionally include other components, particularly to modify characteristics as to anti-knock quality (motor octane number), vapor pressure (RVP), distillation boiling point, detonation suppression, fuel vaporization properties, and other important factors impacting engine performance.

BRIEF DESCRIPTION OF THE PRIOR ART

Motor fuels are used in a variety of systems, including piston or turbine engines. The present invention is directed to fuel formulations which are useful as piston engine fuels, and are particularly suited for use as aviation gasoline (Avgas). Avgas is used in spark-ignited (reciprocating) piston engines to propel aircraft. Avgas is distinguished from mogas (motor gasoline), which is the everyday gasoline used in motor vehicles and some light aircraft.

Avgas has a number of special requirements as compared to ground vehicle gasoline. Aviation gasoline must provide fuel properties that meet the diverse power demands and operating conditions for aircraft engines. Avgas must meet the minimum power rating (motor octane number), display appropriate combustion properties including anti-knocking (detonation suppression), have required volatility (vapor pressure) profiles, and satisfy other criteria established for aircraft fuels.

MON and Anti-Knock:

The motor octane number is a standard measure of the performance of a motor or aviation fuel. The higher the motor octane number, the more compression the fuel can withstand before detonating. A gasoline-fueled reciprocating engine requires fuel of sufficient octane rating to prevent uncontrolled combustion known as engine knocking ("knock" or "ping"). Anti-knock agents allow the use of higher compression ratios for greater efficiency and peak power.

The sufficiency of an aviation gasoline in this respect is represented in part by its motor octane number, or MON. The MON is a measure of how the fuel behaves when under load (stress). ASTM test method 2700, for example, describes MON testing using a test engine with a preheated fuel mixture, 900 rpm engine speed, and variable ignition timing to stress the fuel's knock resistance. The MON of an aviation gasoline can be used as a guide to the amount of knock-limiting power that may be obtained in a full-scale engine under take-off, climb and cruise conditions.

Various MON ratings are considered to be base requirements for aircraft use, depending on the type of engine and other factors. The present invention provides fuels which may have lower MON ratings, but in the preferred embodiment the fuels are aviation fuels which have a MON of at least 100, preferably 102 or greater. It is necessary that unleaded Avgas provide sufficient power under varying conditions, including take-off and climb as well as at cruise, which is recognized to be 2 motor octane numbers above the minimum 99.6 MON of leaded aviation gasoline specified in ASTM D910.

RVP:

The vapor pressure of Avgas is another important factor for Avgas. Aircraft engines operate in wide ranges of temperatures and atmospheric pressures (e.g., altitudes), and the fuels must start and provide sufficient combustion characteristics throughout those ranges. Lower vapor pressure levels are desirable in avoiding vapor lock during summer heat, and higher levels of vaporization are desirable for winter starting and operation. Depending upon the design of the fuel pump, fuel may not be pumped when there is vapor in the fuel line (so called "vapor lock"). Winter starting or high altitude restarts (so called "cold starts") will be more difficult when liquid gasoline in the combustion chambers has not vaporized. Vapor pressure is critically important for aviation gasolines, affecting starting, warm-up, and tendency to vapor lock with high operating temperatures or high altitudes.

The ability of an aviation gas to satisfy the foregoing requirements may be assessed based on the Reid Vapor Pressure (RVP). The Reid vapor pressure is the absolute vapor pressure exerted by a liquid at 37.8° C. (100° F.) as determined by the test method ASTM-D323. The RVP differs from the true vapor pressure due at least in part to the presence of water vapor and air in the confined space. A typical requirement for Avgas is that it has an RVP of 38-49 kilopascals (kPa), as determined in accordance with applicable ASTM standards.

Insolubility:

Avgas must also be highly insoluble in water. Water dissolved in aviation fuels can cause serious problems, particularly at altitude. As the temperature lowers, the dissolved water becomes free water. This then poses a problem if water enters the fuel system, or if ice crystals form, clogging filters and other small orifices, which can result in engine failure.

The present invention provides fuel formulations which are capable of meeting all of these strict requirements. They meet the MON standards, have suitable RVP and are not soluble in water. In a preferred embodiment, the formulations of the present invention meet the specifications set forth in ASTM D7719 for a high aromatic, unleaded hydrocarbon based aviation fuel.

Octane Boosters:

Various techniques exist to increase the motor octane rating of Avgas above the current unleaded blend of aviation alkylates by utilizing hydrocarbon components such as isooctane (or mixtures of isooctane called "super alkylates"), and/or aromatics such as toluene, xylenes or mesitylene. The advantage of these hydrocarbon-based components is the resulting increase in motor octane, their general lack of toxicity, and their more favorable exhaust emission characteristics. A variety of non-hydrocarbon fuel components have been known and used in the art to increase motor octane ratings, and thereby reduce knocking. Typical "octane booster" gasoline components include methyl tert-butyl ether (MTBE), ethyl tert-butyl ether (ETBE), both known as oxygenates, and methylcyclopentadienyl manganese tricarbonyl (MMT). All of these components increase the octane content of gasoline, but may have either toxicity and/or emission issues in various regulatory jurisdictions.

Tetraethyl lead, abbreviated TEL, is an organolead compound with the formula $(CH_3CH_2)_4Pb$. It has been mixed with gasoline since the 1920's as an inexpensive octane booster which allowed engine compression to be raised substantially, which in turn increased vehicle performance and fuel economy. One advantage of TEL is the very low concentration needed. Other anti-knock agents must be used in greater amounts than TEL, often reducing the energy content of the gasoline. However, TEL has been in the process of being phased out since the mid-1970s because of its neurotoxicity and its damaging effect on catalytic converters. Most grades of avgas have historically contained TEL.

This invention produces an unleaded grade of Avgas which allows a range of piston engines, including high-compression engines, to perform effectively. It is an object of the present invention to provide Avgas formulations that utilize the base fuel components of mesitylene and isopentane in combination with other critical fuel components, but without TEL, to meet or exceed the engine performance requirements for high-octane unleaded aviation gasoline.

SUMMARY OF THE INVENTION

This invention provides formulations for Avgas meeting the requirements for use in aircraft, including the requirements established under ASTM standards and by the Federal Aviation Administration. According to one formulation, a binary mixture of 1,3,5-trimethyl benzene (mesitylene) and isopentane is used to provide a MON of at least 100, and more preferably at least 102. In other fuel formulations, the amounts of mesitylene and/or isopentane may be changed, and other fuel components are included. These various Avgas formulations are thereby adjusted to meet a variety of requirements as to octane rating, RVP, cold start, and other fuel characteristics.

DETAILED DESCRIPTION OF THE INVENTION

Figure 1:
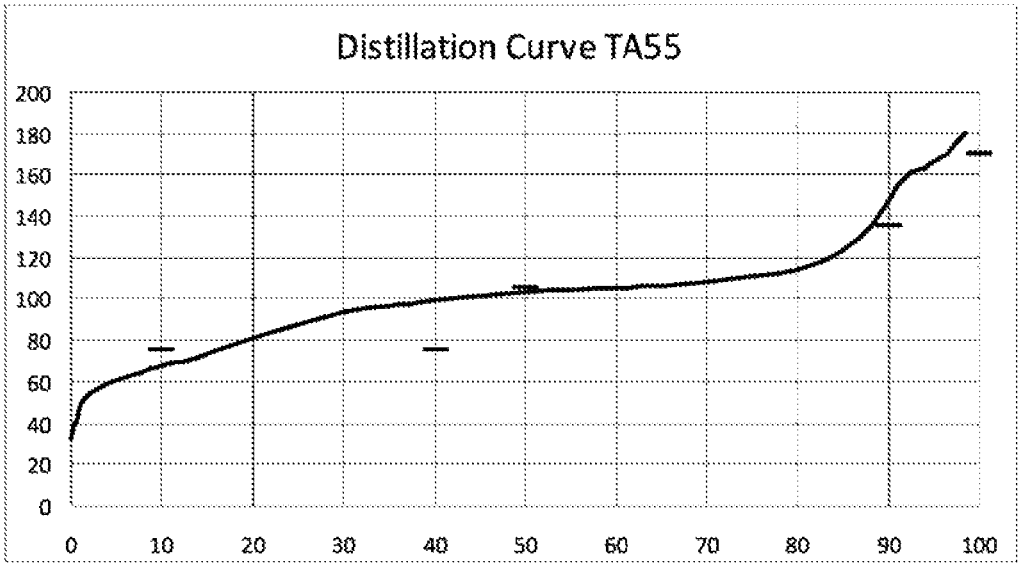
FIG. 1 is a graph showing the distillation curve with the temperature plotted against the volume. The horizontal bars on the graph correlate to the ASTM specification number D7547 and the permissible limits of that specification.

For the purposes of promoting an understanding of the principles of the invention, reference will now be made to certain embodiments and specific language will be used to describe the same. It will nevertheless be understood that no limitation of the scope of the invention is thereby intended, such alterations and further modifications, and such further applications of the principles of the invention as described herein, being contemplated as would normally occur to one skilled in the art to which the invention relates.

The fuel formulations of the present invention are characterized herein in several respects. The included components are identified and ranges of those components are indicated. In making these indications of ranges, it is intended that the specific amounts of each component used in a particular formulation are selected based on certain additional criteria as already discussed. It is within the ordinary skill in the art, given the teachings herein, to determine whether particular formulations satisfy the criteria as set forth in the claims.

The inventive fuels are formulated to qualify as motor fuels, and particularly aviation gasoline, and they therefore satisfy criteria established for such. Thus, a starting point is that the amounts of the various fuel components are selected to provide a minimum MON as established for the applicable use in aviation gasoline. At present, the minimum MON is considered to be 100, although a MON of at least 102 is preferred herein. Similarly, a second important criteria is that the volatility of the fuel satisfy established requirements for aviation gasoline. The Reid vapor pressure (RVP) of the inventive formulations is within the range of 38-49 kilopascals (kPa), as determined in accordance with applicable ASTM standards.

In one embodiment, the present invention comprises 79-85 wt % mesitylene and 15-21 wt % isopentane. This fuel formulation is further characterized by having a MON of at least 100, more preferably at least 102, and an RVP of 38-49 kPa, equivalent to 5.5-7.1 psi. It has been found that the presence of mesitylene supports the high MON of the formulation, while the isopentane contributes to the desired RVP.

To exemplify one aspect of the present invention, tests have been carried out according to ASTM D5191 to determine the Reid vapor pressure as a function of concentration (wt %) of mesitylene for a binary mixture of mesitylene and isopentane. The Reid vapor pressure requirement of 100 LL octane aviation fuel is between 5.5 and 7.1 psi. Mesitylene concentrations of about 70-85 wt % in combination with isopentane were found to meet the Reid vapor pressure requirement for 100 LL octane aviation fuel. By comparison, neither pure mesitylene nor pure isopentane meet this specification.

Further tests were conducted according to six ASTM standards to determine various characteristics of pure mesitylene, pure isopentane, Swift 702 pure fuel according to the present invention (comprised of 83 wt % mesitylene and 17 wt % isopentane) and conventional 100 LL aviation fuel. The results of these comparative tests are illustrated below:

| ASTM Method | Test | Mesitylene | Isopentane | Swift 702 | 100 LL spec |
|---|---|---|---|---|---|
| D2700 | Motor Octane Number | 136 | 90.3 | 104.9 | ≥99.6 |
| D909 | Supercharge ON | 170 | 92.3 | 133.0 | 130.0 |
| D5191 | Vapor Pressure | ≤5.5 | ≥7.1 | 5.7 | 5.5 to 7.1 |
| D2386 | Freezing Pt | −49 | −161 | −63 | ≤58 |
| D86 | 10% Distillation Pt. | 165 | 28 | 65 | ≤75 |
| D86 | End Distillation Pt. | 165 | 28 | 165 | ≤170 |

It has unexpectedly been discovered from these tests that adding isopentane to mesitylene in certain concentrations as called for herein increases the vapor pressure, lowers the freezing point, and lowers the 10% distillation point of the fuel to within the ASTM standard. It was also unexpectedly discovered that adding mesitylene to isopentane to form a 100 octane aviation fuel, as compared to pure isopentane, raises the motor octane number, raises the supercharge octane number, and lowers the vapor pressure to within the ASTM D910 specification.

Variations of the inventive formulations involve the inclusion of one or more fuel components, generally with a modification of the amounts of mesitylene and/or isopentane. In each instance, the components are included in amounts, again, to meet the criteria of the final formulation as having a MON of at least 100, more preferably at least 102, and an RVP of 38-49 kPa. These formulations are further described hereafter.

Certain alkanes are particularly useful for adjusting the MON or RVP of the formulations and to meet cold start requirements. The inclusion of isooctane and/or butane provides the following formulations in accordance with the present invention:

| | Mesitylene | Isopentane | Isooctane | Butane |
|---|---|---|---|---|
| 1 | 70-80 wt % | 15-20 wt % | 0-15 wt % | — |
| 1 | 70-88 wt % | 10-20 wt % | 0-15 wt % | 0-2 wt % |

In refining, the alkylation process transforms low molecular-weight alkenes and iso-paraffin molecules into larger iso-paraffins with a high octane number. The product is referred to as an "alkylate", and includes a mixture of high-octane, branched-chain paraffinic hydrocarbons. This "alkylate" product may contain many hydrocarbon compounds typically in the C4 to C12 range, but particularity isooctane. "Aviation alkylate" is a premium gasoline blending stock because it has exceptional anti-knock properties and is clean burning with a final boiling point appropriate for aviation use. The octane number of the aviation alkylate depends mainly upon the kind of alkenes used and upon refinery operating conditions. For example, isooctane results from combining butylene with isobutane and has an octane rating of 100 by definition. There are other products in the alkylate, so the octane rating will vary accordingly.

This alkylate product from the refineries is also useful in the formulations to address the problem of cold starts. Formulations of the present invention meeting the MON and RVP criteria include the following:

| | Mesitylene | Isopentane | Alkylate | Butane |
|---|---|---|---|---|
| 2 | 75-80 wt % | 15-20 wt % | 0-10 wt % | — |
| 2A | 70-88 wt % | 10-20 wt % | 0-10 wt % | 0-2 wt % |

Whether from the alkylate product of the refineries, or in more isolated form, the inclusion in the inventive fuel formulations of high volatility/low boiling point components (including the isopentane) contributes to achieving the desired RVP range, while also allowing the engines to start in cold temperature situations (cold weather or high altitude).

With the addition of C7 to C9 methyl aromatics other than the mesitylene (e.g. toluene and/or any mixture of xylenes including ortho-, meta- or para-xylene), further fuel formulations are available in accordance with the present invention, as follows:

| | Mesitylene | Isopentane | Toluene | Xylenes | Butane | Isooctane | Alkylate |
|---|---|---|---|---|---|---|---|
| 4B | 44-88 wt % | 10-20 wt % | 0-44 wt % | — | 0-2 wt % | | |
| 4C | 36-88 wt % | 10-20 wt % | 0-44 wt % | 0-35 wt % | 0-2 wt % | | |
| 3C | 68-88 wt % | 10-20 wt % | 0-24 wt % | | 0-2 wt % | 0-15 wt % | 0-5 wt % |
| 3D | 56-88 wt % | 10-20 wt % | 0-24 wt % | 0-30 wt % | 0-2 wt % | 0-15 wt % | 0-5 wt % |

Certain organometallic additives, when included in the formulations shown below, have been found to positively affect other fuel characteristics and provide the resulting MON and RVP that meet the foregoing criteria. For example, iron pentacarbonyl and/or ferrocene may be added in low amounts, e.g., 0 up to 2,000 ppm, to these listed formulations and others resulting in an unexpected increase in the MON. For example, lab results indicate that about 500 ppm of iron pentacarbonyl unexpectedly boosts octane for the base fuel up to 2.5 MON.

| | Mesitylene | Isopentane | Isooctane | Butane | Alkylate | Toluene | Xylenes |
|---|---|---|---|---|---|---|---|
| 3 | 70-80 wt % | 15-20 wt % | 0-15 wt % | — | | | |
| 3A | 70-88 wt % | 10-20 wt % | 0-15 wt % | 0-2 wt % | | | |
| 3B | 70-88 wt % | 10-20 wt % | 0-25 wt % | 0-2 wt % | 0-10 wt % | | |
| 2 | 75-80 wt % | 15-20 wt % | | | 0-10 wt % | | |
| 4B | 44-48 wt % | 10-20 wt % | | 0-2 wt % | | 0-44 wt % | |
| 3C | 68-88 wt % | 10-20 wt % | 0-15 wt % | 0-2 wt % | 0-5 wt % | 0-24 wt % | |
| 3D | 56-88 wt % | 10-20 wt % | 0-15 wt % | 0-2 wt % | 0-5 wt % | 0-24 wt % | 0-30 wt % |
| 4C | 36-88 wt % | 10-20 wt % | — | 0-2 wt % | — | 0-44 wt % | 0-35 wt % |

It will be appreciated by those skilled in the art that the described formulations can be adjusted to meet various MON ratings and RVP based on the teachings herein. Requirements for aviation gasoline are established by the FAA and other sanctioning bodies in the US and throughout the world. The present invention notes that the basic combination of mesitylene and isopentane provides a fuel formulation which can be adjusted to meet various MON and RVP requirements. Various other characteristics of the Avgas may thereby also be accommodated, such as cold starting and reduced carbon smoke. The fuel formulations may also be optimized in regard to the availability and cost of the various components which may be included, while still meeting the criteria for aviation gasoline.

Accordingly, for purposes herein applicant refers to an "established" criteria or requirement as one that is determined at any point in time to apply to the characteristics of an aviation gasoline in a given country. For example, the "established" minimum MON rating for aviation gasoline based upon ASTM D910 is currently 99.6 for 100 LL fuel. However, it is recognized that a newly "established" minimum MON rating for unleaded aviation gasoline in the future may differ, e.g., be set at a MON of 102. The present invention is therefore directed also to meeting such changed or new criteria, particularly as to the required MON or RVP for the Avgas.

Throughout this disclosure various components for the inventive fuel formulations have been identified. It will be appreciated that it is not necessary for these components to be in a pure form. It is only necessary that the formulations not include a deleterious amount of other components, particularly so as to cause the MON or RVP to fall outside the stated ranges. At the same time, the present invention may use materials which satisfy these conditions and are less expensive and/or more readily available than more pure grades of components. By way of example, mesitylene may be obtained as a mixture with minor amounts of pseudocumene, and such product may be usefully employed in accordance with the present invention.

The inventive fuels may "comprise" the described formulations, in which case other components may be included. However, in a preferred embodiment, the inventive fuels "consist of" the described formulations, in which no other components are present. In addition, the inventive fuels may "consist essentially of" the formulations, in which case other fuel excipients, and/or non-deleterious components, may be present. As used herein, the term "fuel excipients" refers to materials which afford improved performance when using the fuels, but which do not significantly impact the basic characteristics of the formulation—e.g., the MON and RVP. Fuel excipients thus may include, for example, antioxidants, etc.

The formulations are also useful for combining with other fuel components to form blends that are useful as motor fuels, including as aviation gasoline. As used herein, the term "fuel additives" refers to materials which are themselves combustible and have varying motor octane ratings and are included primarily to provide improved combustion characteristics of the blend. In preferred embodiments, such fuel additives are present in the blend at less than 5 wt %, and more preferably less than 1 wt %.

Example 1 TA-55

The fuel components of Table 1 were combined according to methods well known in the art to prepare 94 MON motor fuel and this composition was labeled TA-55.

TABLE 1

Composition of TA-55.

| Fuel Components: | Mass [g] | Mass [%] |
|---|---|---|
| Isopentane | 6,300 | 15.00% |
| Alkylates TA37 | 5,754 | 13.70% |
| Isooctane TA44 | 25,746 | 61.30% |
| Mesitylene | 4,200 | 10.00% |

The fuel composition of TA-55 was analyzed to determine the motor octane number (MON) of the composition and the MON was found to be 94.3 and the research octane number (RON) was found to be 100. The fuel composition of TA-55 was distilled and a distillation curve was prepared with the temperature plotted against volume. The horizontal bars on the graph correlate to the ASTM specification number D7547 and the permissible limits (max or min) of that specification as shown in FIG. 1.

Example 2 TA-71

In one embodiment of the present invention, the fuel components of Table 2 were combined according to methods well known in the art to prepare an aviation fuel and was labeled TA-71.

TABLE 2

Composition of TA-71

| Fuel Components: | Mass [g] | Mass [%] |
|---|---|---|
| Butane | 5.5 | 1.00% |
| Isopentane | 71.5 | 13.00% |

TABLE 2-continued

Composition of TA-71

| Fuel Components: | Mass [g] | Mass [%] |
|---|---|---|
| Toluene | 165 | 30.00% |
| Mesitylene | 308 | 56.00% |

The fuel composition of TA-71 was analyzed to determine the motor octane number (MON) of the composition and was found to be 102.0.

Example 3 TA-73

In one embodiment, the fuel components of Table 3 were combined according to methods well known in the art to prepare an aviation fuel and the composition was labeled TA-73.

TABLE 3

Composition of TA-73

| Fuel Components: | Mass [g] | Mass [%] |
|---|---|---|
| Butane | 5.5 | 1.0% |
| Isopentane | 71.5 | 13.0% |
| Toluene | 165 | 30.0% |
| Mesitylene | 308 | 56.0% |
| Iron pentacarbonyl | 0.275 | 0.05% |

The fuel composition of TA-73 was analyzed to determine the motor octane number (MON) of the composition and the MON was found to be 102.8.

Example 4 TA-74

In one embodiment, the fuel components of Table 4 were combined according to methods well known in the art to prepare an aviation fuel and the composition was labeled TA-74.

TABLE 4

Composition of TA-74

| Fuel Components: | Mass [%] | Mass [g] |
|---|---|---|
| Isopentane | 15.00% | 135 |
| Alkylates TA37 | 13.70% | 123.3 |
| Isooctane TA44 | 61.30% | 551.7 |
| Mesitylene | 10.00% | 90 |
| Iron pentacarbonyl | 0.05% | 0.450 |

The fuel composition of TA-74 was analyzed to determine the motor octane number (MON) of the composition and the MON was found to be 96.5. This case demonstrates an unexpected increase in MON of 2.2 vs Example 1 (TA-55).

Example 5. TA-68

In one embodiment, the fuel components of Table 5 were combined to prepare an aviation fuel and the composition was labeled TA-68.

TABLE 5

| Composition of TA-68 | | |
|---|---|---|
| Fuel Components: | Mass [%] | Mass [g] |
| Isopentane | 10.00% | 55 |
| Butane | 2.00% | 11 |
| Toluene | 13.00% | 71.5 |
| Mesitylene | 75.00% | 412.5 |

The fuel composition of TA-68 had a MON of 105. The fuel composition of TA-68 was distilled and a distillation curve was prepared with the temperature plotted against volume. The fuel composition was found to meet the distillation requirements of ASTM specification number D7719.

Example 6. TA-80

In one embodiment, the fuel components of Table 6 were combined to prepare an aviation fuel and the composition was labeled TA-80.

TABLE 6

| Composition of TA-80 | | |
|---|---|---|
| Fuel Components: | Mass [%] | Mass [g] |
| Isopentane | 18.00% | 126 |
| Isooctane | 27.00% | 189 |
| Toluene | 10.00% | 70 |
| m-Xylene | 10.00% | 70 |
| Mesitylene | 30.00% | 210 |
| m-Toluidiene | 5.00% | 35 |

The fuel composition of TA-80 had a MON of 102.1. The fuel composition of TA-80 was distilled and a distillation curve was prepared with the temperature plotted against volume. The fuel composition was found to meet the distillation requirements of ASTM specification number D7719.

Example 7. TA-81

In one embodiment, the fuel components of Table 7 were combined to prepare an aviation fuel and the composition was labeled TA-81.

TABLE 7

| Composition of TA-81 | | |
|---|---|---|
| Fuel Components: | Mass [%] | Mass [g] |
| Isopentane | 13.00% | 91 |
| Butane | 2.00% | 14 |
| Isooctane | 15.00% | 105 |
| ETBE | 15.00% | 105 |
| Toluene | 10.00% | 70 |
| m-Xylene | 10.00% | 70 |
| Mesitylene | 30.00% | 210 |
| Aniline | 5.00% | 35 |

The fuel composition of TA-81 had a MON of 102.3. The fuel composition of TA-81 was distilled and a distillation curve was prepared with the temperature plotted against volume. The fuel composition was found to meet the distillation requirements of ASTM specification number D7719.

Example 8. TA-82

In one embodiment, the fuel components of Table 8 were combined to prepare an aviation fuel and the composition was labeled TA-82.

TABLE 8

| Composition of TA-82 | | |
|---|---|---|
| Fuel Components: | Mass [%] | Mass [g] |
| Isopentane | 10.00% | 70 |
| Butane | 2.00% | 14 |
| Isooctane | 18.00% | 126 |
| ETBE | 15.00% | 105 |
| Toluene | 10.00% | 70 |
| m-Xylene | 10.00% | 70 |
| Mesitylene | 35.00% | 245 |

The fuel composition of TA-81 had a MON of 102.2. The fuel composition of TA-82 was distilled and a distillation curve was prepared with the temperature plotted against volume. The fuel composition was found to meet the distillation requirements of ASTM specification number D7719.

Example 9

Figure 2:
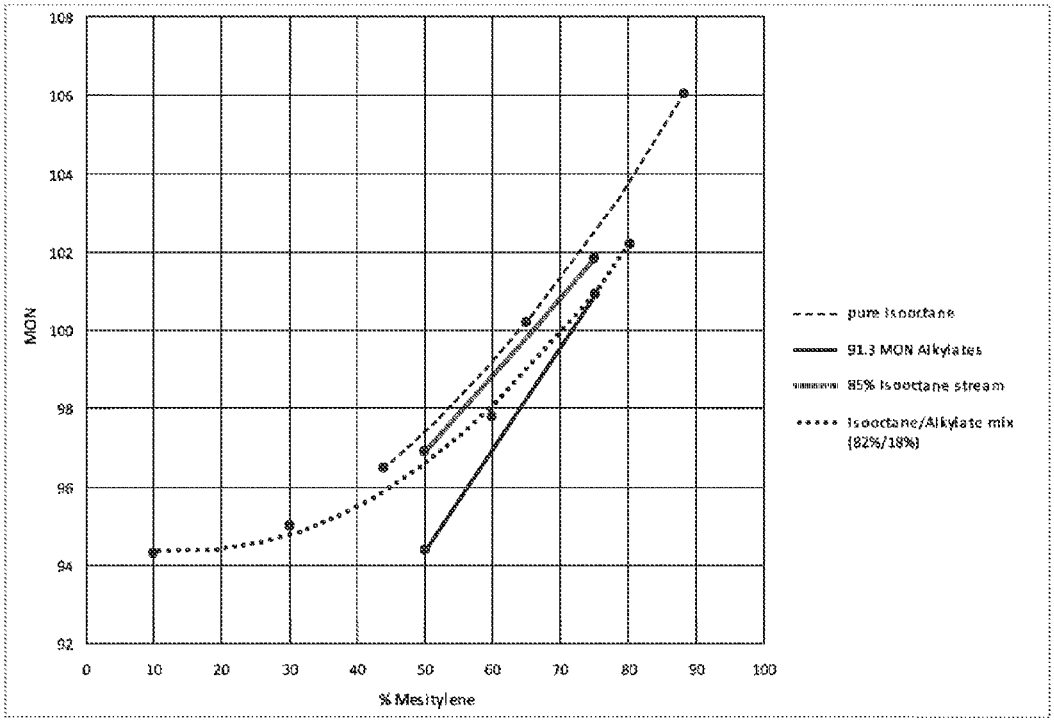
FIG. 2 is a graph showing the MON of various compositions graphed against the percentage of mesitylene present in the composition.

In an effort to better understand how additional components of aviation fuel affect the MON of a fuel composition comprising mesitylene, the MON of various compositions was graphed against the percentage of mesitylene present in the composition, and is shown in FIG. 2.

It is a further purpose and advantage of the present invention to provide Avgas formulations which have preferred components for other reasons. For example, the present formulations may be accurately referred to as comprising high aromatics and being hydrocarbon based. While other components may be included, preferred formulations are substantially free, or even completely free, of such other materials as sulfur components and aromatic amines.

Further, it has been common in the prior art to include TEL (tetraethyl lead) in motor fuels to provide anti-knock properties. Such fuels have generally been referred to as low lead or "LL". It is another feature of the present invention that the formulations and blends do not require the use of TEL, a known carcinogen. Therefore, in a preferred embodiment the inventive formulations and blends are unleaded, i.e., free of TEL. This is made possible, at least in part, by the presence of the 1,3,5-trimethylbenzene, which provides sufficiently high MON performance and anti-knocking characteristics under stress to offset the absence of TEL in the aviation gasoline.

All component percentages expressed herein refer to percentages by weight of the formulation, unless indicated otherwise. The term "substantially free" of a component refers to the fact that less than 5 wt % of that component is present, and preferably less than 1 wt % is present.

The uses of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein.

Any methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

While the invention has been illustrated and described in the foregoing description, the same is to be considered as illustrative and not restrictive in character, it being understood that only certain preferred embodiments have been described and that all changes and modifications that come within the spirit of the invention are desired to be protected. In addition, all references cited herein are indicative of the level of skill in the art and are hereby incorporated by reference in their entirety.

What is claimed is:

1. A motor fuel having a MON of at least 100 and an RVP of 38-49 kPa at 38° C. comprising 70-80 wt % mesitylene, isopentane in an amount up to 20 wt %, and isooctane in an amount up to 15 wt %.

2. The motor fuel of claim 1 in which the isooctane is provided as a component of aviation alkylate.

3. The motor fuel of claim 1 and further comprising butane in an amount up to 2 wt %.

4. The motor fuel of claim 1 comprising 75-80 wt % mesitylene, 15-20 wt % isopentane, and alkylate in an amount up to 10 wt %, the alkylate comprising isooctane.

5. The motor fuel of claim 1 comprising 10-20 wt % isopentane, alkylate in an amount up to 10 wt %, and butane in an amount up to 2 wt %.

6. A motor fuel having a MON of at least 100 and an RVP of 38-49 kPa at 38° C. comprising 56-88 wt % mesitylene, 10-20 wt % isopentane, isooctane in an amount up to 15 wt %, butane in an amount up to 2 wt %, and alkylate.

7. A motor fuel having a MON of at least 100 and an RVP of 38-49 kPa at 38° C. comprising 70-88 wt % mesitylene, 10-20 wt % isopentane, isooctane in an amount up to 25 wt %, butane in an amount up to 2 wt %, and alkylate in an amount up to 10 wt %.

8. A motor fuel having a MON of at least 100 and an RVP of 38-49 kPa at 38° C. comprising about 10.0 wt % mesitylene, 15.0 wt % isopentane, 61.3 wt % isooctane, and 13.7 wt % alkylate.

9. The motor fuel of claim 1 comprising 2 wt % butane.

10. The motor fuel of claim 5 comprising 10 wt % isopentane, alkylate in an amount of up to 10 wt. %, and 2 wt % butane.

11. The motor fuel of claim 6 comprising 56-88 wt. % mesitylene, isooctane in an amount of up to 15 wt. %, 10 wt % isopentane and 2 wt % butane.

12. The motor fuel of claim 7 comprising 70-88 wt. % mesitylene, isooctane in an amount of up to 25 wt. %, alkylate in an amount of up to 10 wt. %, 10 wt % isopentane and 2 wt % butane.

* * * * *